US005415579A

United States Patent [19]

Pracas

[11] Patent Number: 5,415,579

[45] Date of Patent: May 16, 1995

[54] DOLL WITH PIVOTING EYEBALLS, HEART BEAT, VOICE MEANS, BURPING SOUNDS AND ACTUATING TRANSMITTER

[75] Inventor: Victor M. Pracas, Waroona, Australia

[73] Assignee: Concepts Development Australia PTY LTD, Australia

[21] Appl. No.: 133,164

[22] PCT Filed: Apr. 24, 1992

[86] PCT No.: PCT/AU92/00101

§ 371 Date: Oct. 22, 1993

§ 102(e) Date: Oct. 22, 1993

[87] PCT Pub. No.: WO92/19343

PCT Pub. Date: Nov. 12, 1992

[30] Foreign Application Priority Data

Apr. 24, 1991 [AU] Australia ..... PK5781
May 30, 1991 [AU] Australia ..... PK6400

[51] Int. Cl.[6] ..... A63H 03/28; A63H 03/40; A63H 03/48

[52] U.S. Cl. ..... 446/295; 446/297; 446/301; 446/343; 446/345

[58] Field of Search ..... 446/139, 295, 301, 341–343, 446/345, 348, 349

[56] References Cited

U.S. PATENT DOCUMENTS

| | | | |
|---|---|---|---|
| 2,218,044 | 10/1940 | Marquis | 446/301 |
| 2,854,788 | 10/1958 | Baggott | 446/345 |
| 3,292,610 | 12/1966 | Newman | 446/301 |
| 3,293,795 | 12/1966 | Ryan | 446/301 |
| 3,295,253 | 1/1967 | Gardel | 46/135 |
| 3,383,793 | 5/1968 | Bonanno | 446/343 |
| 3,563,229 | 2/1971 | Petrusson | 446/295 |
| 3,616,572 | 11/1971 | Kosicki et al. | 446/345 |
| 3,628,283 | 12/1971 | Mizoule . | |
| 3,660,932 | 5/1972 | Raffeli et al. | 446/343 |
| 3,835,561 | 9/1974 | Camerino | 446/343 |
| 3,888,233 | 6/1975 | Ware | 446/295 |
| 3,918,199 | 11/1975 | De Masi | 446/301 |
| 4,166,337 | 9/1979 | Kosicki et al. | 446/295 |
| 4,231,184 | 11/1980 | Corris et al. | 446/301 |
| 4,424,644 | 1/1984 | Sapkus et al. | 46/135 |
| 5,083,965 | 1/1992 | Mayem | 446/305 |
| 5,092,811 | 3/1992 | Bergenguer | 446/301 |
| 5,281,183 | 1/1994 | Bernhardt et al. | 446/345 |

FOREIGN PATENT DOCUMENTS

| | | | |
|---|---|---|---|
| 35748/78 | 11/1979 | Australia . | |
| 66333/81 | 7/1981 | Australia . | |
| 32843 | 7/1981 | European Pat. Off. | 446/301 |
| 1023644 | 8/1950 | France . | |
| 2008775 | 1/1970 | France . | |
| 701036 | 7/1953 | United Kingdom | 446/301 |
| 2196545 | 5/1988 | United Kingdom | 446/297 |

*Primary Examiner*—Robert A. Hafer
*Assistant Examiner*—Jeffrey D. Carlson
*Attorney, Agent, or Firm*—Gipple & Hale

[57] ABSTRACT

A doll constructed with a body having a head with at least one eye comprising a pivotal eye ball assembly pivotally retained in a casing. A first arm extends from a main portion of the eye ball assembly and a solenoid with a movable solenoid bolt and a second arm and mechanical assembly movable by the solenoid bolt pivots the eye ball between first and second positions simulating a closed and open eye. The solenoid bolt is moveable between a first position and a second position, so that when the doll is in a substantially horizontal position the solenoid bolt moves from a first position to a second position moving the second arm to cause the eye ball to pivot from the first position to the second position. This is accomplished when a receiver in the doll no longer receives a signal transmitted from a transmitter carried by the child. The doll appears to awaken when the child leaves the room.

31 Claims, 6 Drawing Sheets

DOLL WITH PIVOTING EYEBALLS, HEART BEAT, VOICE MEANS, BURPING SOUNDS AND ACTUATING TRANSMITTER

DESCRIPTION

The present invention relates to a doll.

FIELD OF THE INVENTION

The present invention seeks to provide a doll as a child's toy with a high degree of realism which reflects and enhances the love a mother feels for her baby. It is believed that this degree of realism has not previously been obtained in a doll in the manner of the present invention.

SUMMARY OF THE INVENTION

The present invention seeks to provide a doll to simulate a baby (or an infant) awakening when the mother leaves the baby after having put it to sleep, the doll of the present invention simulates this by opening its eyes when the child leaves it. The doll is also able to simulate the cry of a baby as it awakes upon the mother leaving the baby. This awakening of the doll may be triggered by signal transmitting and signal receiving means. The signal transmitting means may be carried by the child and be preferably heart shaped further symbolizing the love existing between a mother and her baby. The simulated cry of a baby may be produced by a sound/voice synthesizer.

The present invention also provides a second mode for the doll in which a speech synthesizer comes into operation.

The present invention additionally seeks to provide a doll having a heart beat simulator. This may be activated by a listener pressing his/her ear to the chest of the doll and gives an additional dimension of realism to the doll.

The present invention also seeks to provide a doll having a belch/"burp" simulator which can be activated such that a belch/"burp" sound is emitted from the doll, thus simulating the sound of a feeding baby.

The present invention further seeks to provide a doll having a disabling arrangement such that the only function that is not disabled is the heart beat simulator. The doll will thus not awake, cry, belch/"burp" or speak; the heart beat will, however, still be able to be activated.

The embodiment of the disabling arrangement may be in the form of a dummy which is inserted into the mouth of the doll. The mouth contains a mouth switch into which the dummy is inserted to disable all functions (except for the heart beat as above stated).

In accordance with one aspect of the present invention there is provided a doll comprising: a body having a head with at least one eye, said eye comprising a pivotal eye ball means; solenoid means having a movable solenoid bolt; separate signal transmitting means; and, said body provided with signal receiving means, wherein said eye ball means is pivotable between first and second positions simulating a closed and open eye, respectively, and said solenoid bolt is movable between first and second positions such that when said doll is in a substantially horizontal position and a signal emitted by said signal transmitting means is not received by said signal receiving means, said solenoid bolt moves from said first position to said second position which causes said eye ball means to pivot from said first position to said second position.

In accordance with another aspect of the present invention there is provided a doll comprising:

a body having a head with at least one eye, said eye comprising a pivotal eye ball means pivotally retained in casing means; first arm means extending from a main portion of said eye ball means; solenoid means having a movable solenoid bolt and second arm means movable by said solenoid bolt, said second arm means connected to pivotal rod means; resilient means provided to bias said rod means and said second arm in a first direction, and retain said solenoid bolt in a first position, wherein said eye ball means is pivotable between first and second positions simulating a closed and open eye, respectively, and said solenoid bolt is movable between said first position and a second position, such that when said doll is in a substantially horizontal position and said solenoid bolt moves from said first position to said second position, said second arm means moves to cause said eye ball means to pivot from said first position to said second position.

DESCRIPTION OF THE INVENTION

Figure 1:
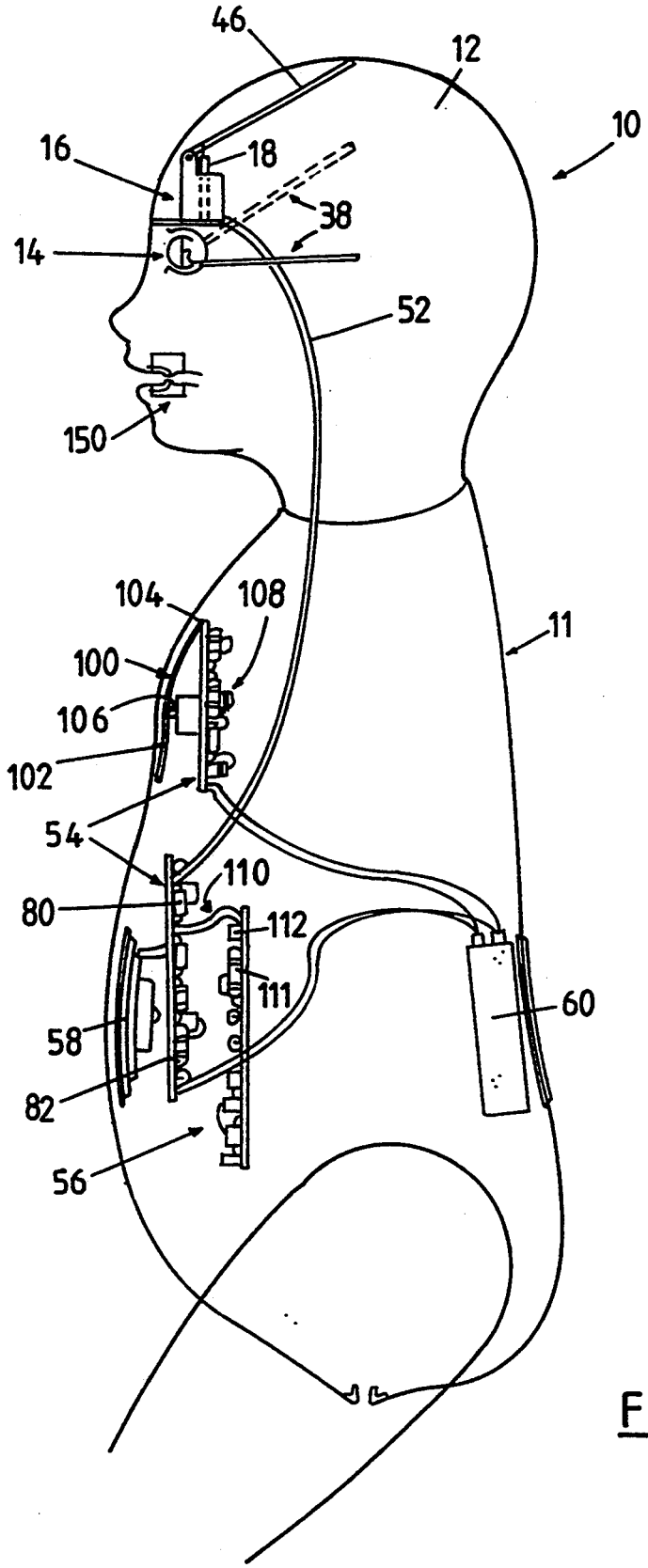
FIG. 1 is a side elevational view of an embodiment of a doll in accordance with the present invention showing the inside thereof.
Figure 5:
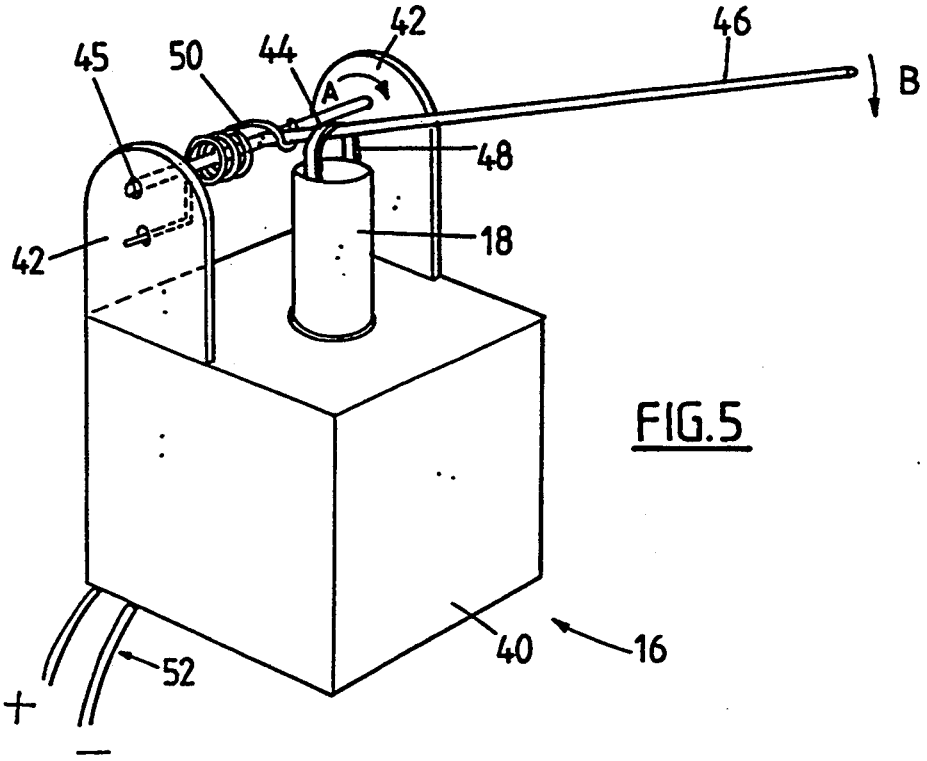
FIG. 5 is a perspective view of the solenoid arrangement of the doll shown in FIG. 1.
Figure 8:
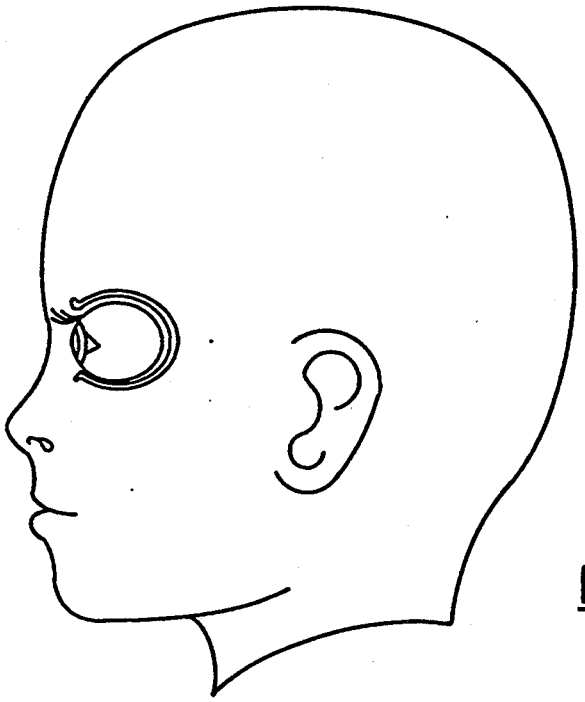
FIG.8 PRIOR ART
FIG. 8 is a side elevational view of the head of a conventional doll, showing a prior art arrangement of the eye and head eye socket arrangement of the doll.

In FIG. 1, there is shown a doll 10 comprising a body 11 having a head 12 with eyes 14, and a solenoid arrangement 16 having a solenoid bolt 18. One of the eyes 14 is shown in greater detail in FIG. 2 and the solenoid arrangement 16 is shown in greater detail in FIG. 5.

Each eye 14 comprises a pivotal eye ball 20 which is pivotally held in a casing 22.

The eye ball 20 simulates the eye ball in a real eye and the casing 22 corresponds to the socket of a real eye.

The casing 22 is provided with an opening 24 at the front thereof and with a slit 26 at the rear thereof.

The eye ball 20 has a main portion 32 which is curved and which can protrude slightly through the opening 24 in the casing 22. The main portion 32 comprises a first portion 30 which is coloured to simulate the iris and cornea of a real eye and a second portion 33 which is flesh coloured to simulate the eye lid of a real eye.

The eye ball 20 is pivotally held in the casing 22 by pins 34 which extend from the eye ball 20 and are held in openings 36 of the casing 22.

An arm like member 38 extends from the back of the main portion 32 of the eye ball 20 and extends outwardly of the casing 22 through the slit 26.

Figure 2:
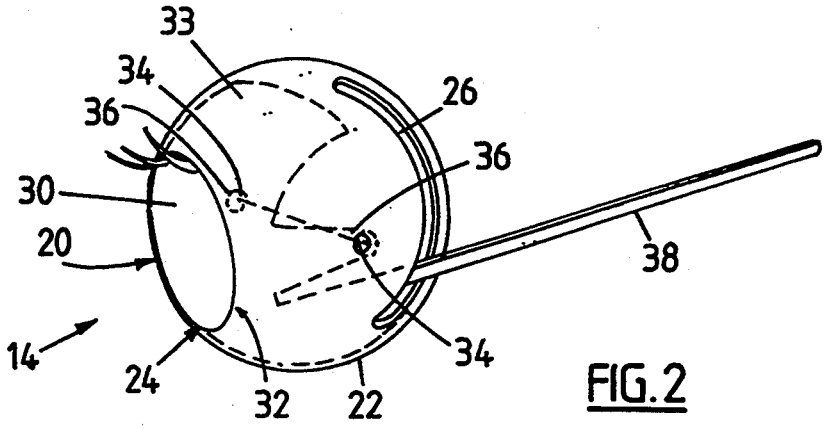
FIG. 2 is a perspective view of an eye of the doll shown in FIG. 1.

The eye ball 20 is weighted such that it sits in the position shown in FIG. 2 (and in FIG. 3) under influence of gravity when the doll 10 is in a substantially upright position. In this way, the eyes 14 are open and simulate an awake infant.

The solenoid arrangement 16 comprises a solenoid coil (hidden from view) contained in a housing 40. Energization of the solenoid coil causes the solenoid bolt 18 to move as will be later herein described.

The solenoid casing 40 has a pair of lugs 42 extending therefrom on opposed sides thereof. A rod 44 extends between a pair of openings 45 provided in the lugs 42 such that the rod 44 is pivotal in the openings 45. An arm like member 46 is connected to the rod 44. The upper part of the solenoid bolt 18 is provided with a loop 48 and the arm like member 46 extends through the loop 48.

A biasing member, which may be in the form of a spring 50 is provided to bias the solenoid bolt 18 out of the solenoid casing 40 and retain the arm like member 48 upwardly when the solenoid coil is not energised. The spring 50 is connected to one of the lugs 42 and is coiled about the rod 44 and hooks under the arm like member 46 since the arm like member extends through the loop 48, the spring 50 also biases the solenoid bolt out of the solenoid coil.

Figure 10:
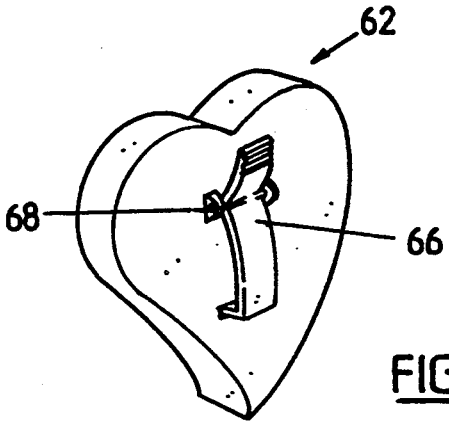
FIG. 10 is a rear perspective view of the signal transmitting device shown in FIG. 9.
Figure 11:
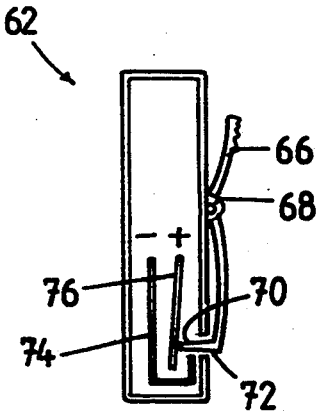
FIG. 11 is a side elevational view of the signal transmitting device shown in FIG. 9 showing the internal contacts.
Figure 12:
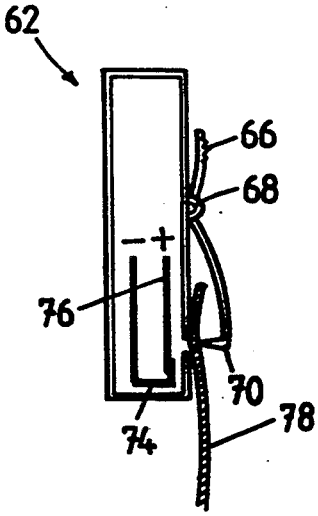
FIG. 12 is another side elevational view of the signal transmitting device shown in FIG. 9 showing the internal contacts.

Electrical leads 52 extend from the solenoid arrangement 16 to electronic circuitry 54. A signal receiving unit 56 is also connected to the electronic circuitry 54 as is a loud speaker 58. The electronic circuitry 54 is connected to a power source, which may be in the form of a cell or battery of cells 60. A signal transmitting unit 62 is shown in FIGS. 9 to 13. The signal transmitting unit 62 is provided with electronic circuitry 64 which transmits a signal which can be received by the signal receiving unit 56 inside the doll 10. The signal transmitting unit 62 is provided with a power source (not shown) which may, once again, be in the form of a cell or battery of cells. The signal transmitting unit 62 has a clip 66 at the rear thereof, as shown in FIGS. 10 to 12 for attachment to a garment.

The clip 66 is pivotally connected to the signal transmitting unit 62 by a pivotal connection 68. The clip 66 has a blunt pin 70 at one end thereof. The clip 66 is biased by biasing means (not shown) such that the blunt pin 70 projects into a hole 72 in the signal transmitting unit 62.

Inside the signal transmitting unit 62 there are a pair of contacts 74 and 76.

When the blunt pin 70 projects into the hole 72, it pushes the contact 76 out of contact from the contact 74. This breaks the circuit 64 and the signal transmitting unit 62 is in the OFF condition. This is shown in FIG. 11. When the blunt pin 70 is out of the hole 72, the contact 76 moves into contact with the contact 74 to complete the circuit 64 and the signal transmitting unit 62 is in the ON condition. This is shown in FIG. 12. The ON condition can be obtained by pivoting the clip 66 such that the blunt pin 70 is out of the hole 72 and then placing a piece of suitable material 78 between the blunt pin 70 and the hole 72. This keeps the blunt pin 70 out of the hole 72 and the signal transmitting unit 62 is kept in the ON condition. The piece of material 78 may be a garment, as will be later herein described. Preferably, the signal transmitting until 62 is heart shaped.

Figure 6:
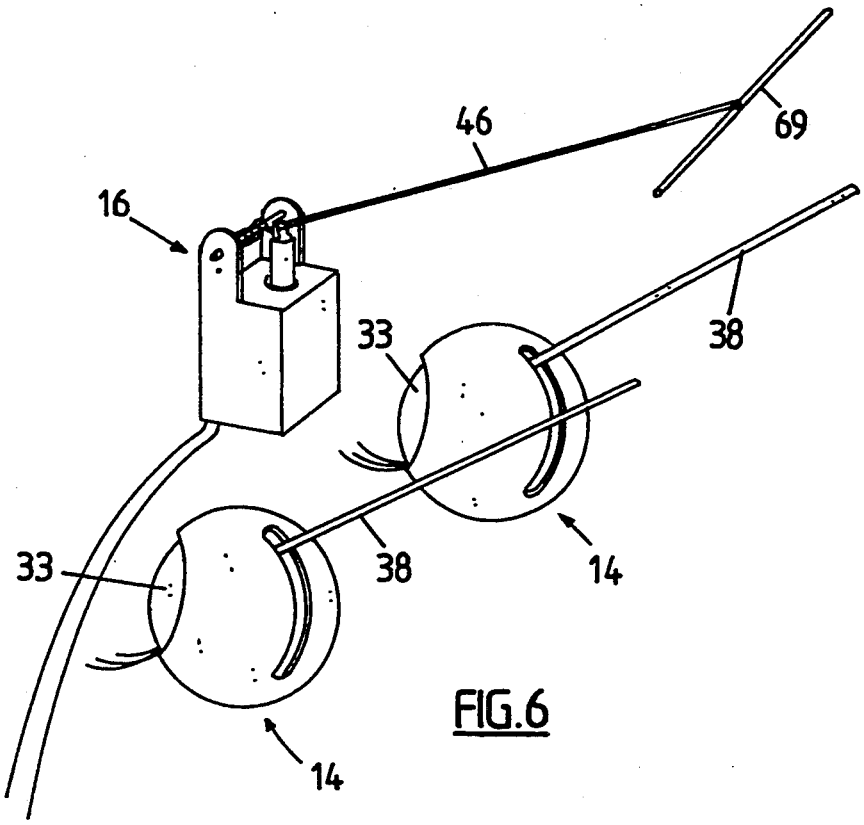
FIG. 6 is a first perspective view showing the solenoid bolt of the solenoid and the eye balls of the eyes of the doll shown in FIG. 1 in first positions.

The manner of operation and use of the doll 10 of the present invention as hereinabove described, will now be described in further detail. The following description of the operation and use of the doll 10 commences with the solenoid arrangement 16 being in a position in which the solenoid bolt 18 is outside of the solenoid casing 40, as shown in FIGS. 1 and 6.

When the doll 10 is in an upright position, as shown in FIG. 1, the weighted eye balls 20 sit in the casings 22 relative to the head 12 of the doll 10 such that the first portions 30, simulating the irises, protrude from the openings 24 of the casings 22. In this way, the eyes 14 are open and an awake infant is simulated by the doll 10. When the doll 10 is moved into a substantially horizontal position, simulating a recumbent or sleeping infant, the position of the eyeballs 20 relative to the casings 22 alters.

Figure 4:
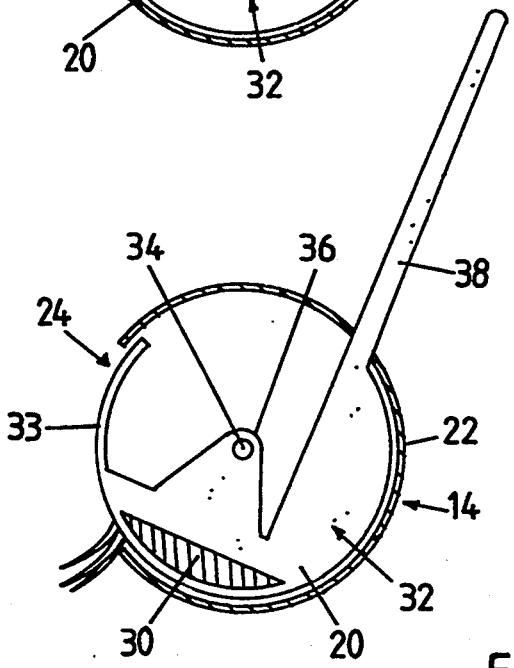
FIG. 4 is a second side elevational view of the eye shown in FIG. 2 showing the position of the eye ball when the doll is in a horizontal position.

Since the eye balls 20 are weighted, they actually remain in the same positions. However, since the casings 22 are fixed relative to the head 12, when the doll 10 is moved to a substantially horizontal position (that is, to substantially 90° from the upright position shown in FIG. 1) the casings 22 are moved such that the openings 24 are uppermost. Since the eye balls 20 are pivotally retained by the pins 34 and openings 36 with the casings 22, the eye balls 20 are not fixed with the casings 22. When the doll 10 is moved into a substantially horizontal position, the casings 22 effectively pivot relative to the eye balls 20 such that the openings 24 of the casings 22 are uppermost. The second portions 33, simulating the eye lids of real eyes, protrude through the openings 24 of the casings 22. The relative positions of the eye balls 20 and the casings 22, in this situation, are shown in FIG. 6. In this way, the eyes 14 are closed and the doll 10 simulates a sleeping infant. Thus, when the doll 10 is in a substantially horizontal position, the arm like members 38 are positioned as shown in FIGS. 4 and 6 and in broken lines in FIG. 1.

Figure 3:
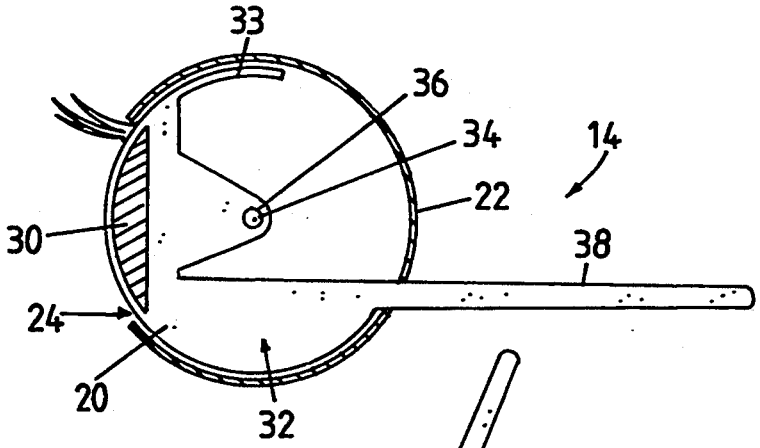
FIG. 3 is a first side elevational view of the eye shown in FIG. 2 showing the position of the eye ball when the doll is in an upright position.

If the doll 10 is returned to the upright position, the relative orientation of the eye balls 20 and the casings 22 would return to the position shown in FIGS. 1 and 3. When the doll 10 is in a substantially horizontal position, i.e. with the eyes 14 closed simulating a sleeping infant, the solenoid arrangement 16 may be activated to cause the eyes 14 to open to simulate an awake infant. When this occurs, the eye balls 20 pivot from their (first) positions in which the first portions 30 protrude from the openings 24 of the casings 22 to (second) positions in which the second portions 33 protrude from the openings 24. When the solenoid arrangement 16 is activated, the solenoid coil inside the casing 40 is energised and the magnetic field created by the solenoid coil causes the solenoid bolt 18 to be drawn into the solenoid coil. This movement of the solenoid bolt 18 from the first position (shown in FIG. 6) to a second position (shown in FIG. 7, in which the solenoid bolt 18 is drawn into the solenoid coil), causes the rod 44 to pivot in the direction shown by arrow A in FIG. 5 since the loop pulls down on the arm like member 46. Thus, the arm like member 46 also moves in the direction shown by arrow B in FIG. 5.

The end of the arm like member 46 may be provided with a transverse member 69. (Alternatively, a transverse member may connect the arm like members 38 of the eyes 14). When the arm like member 46 pivots downwardly in the direction shown by arrow B, the transverse member 69 bears downwardly upon the arm like members 38 of the eye balls 20 of the eyes 14 causing the eye balls 20 to pivot by way of the pins 34 and openings 36 from their first positions shown in FIG. 6 (in which the eyes 14 are closed) to their second positions shown in FIG. 7 (in which the eyes 14 are open).

Figure 7:
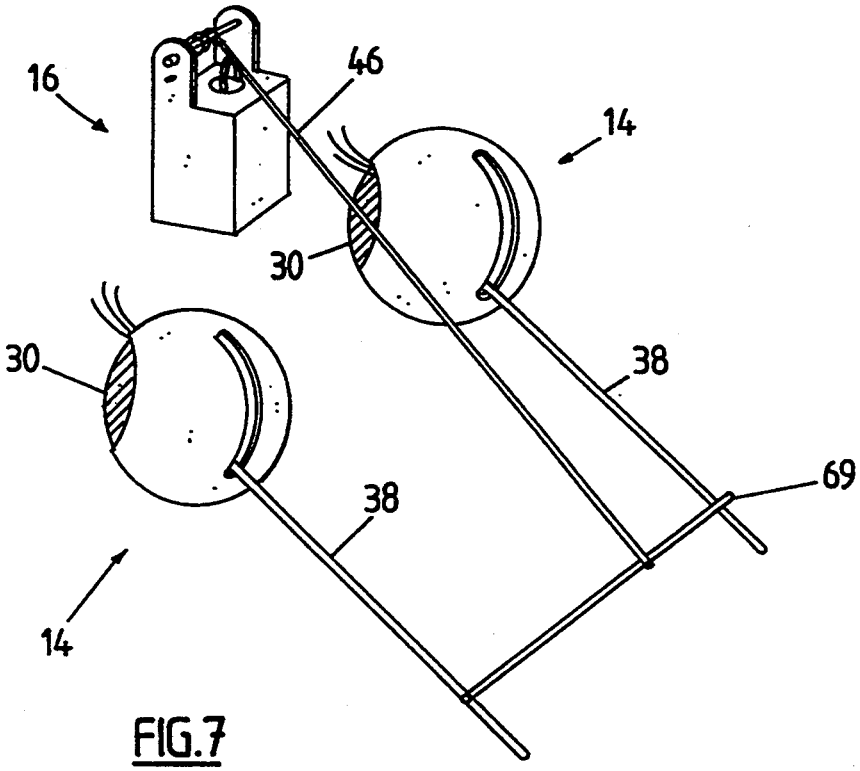
FIG. 7 is a second perspective view, similar to FIG. 6, but with the solenoid bolt and eye balls in second positions.
Figure 9:
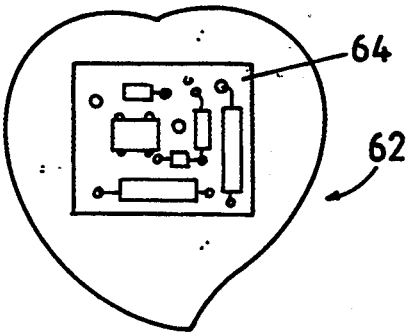
FIG. 9 is a view of the signal transmitting device showing, schematically, the internal electronic circuitry.
Figure 13:
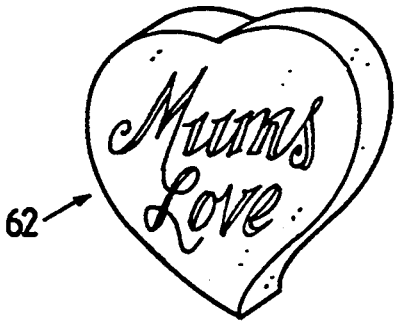
FIG. 13 is a front perspective view of the signal transmitting device shown in FIG. 9.

In FIG. 6, it is the second portions 33 (simulating the eye lids) that protrude from the openings 24 of the casings 22 whilst in FIG. 7, it is the first portions 30 (simulating the irises) of the eye balls 20 that protrude from the openings 24 of the casings 22. Thus, when the solenoid bolt 18 has moved to its second position (as shown in FIG. 7), the (open) eyes 14 simulate an awake infant, even though the doll 10 is in a substantially horizontal, i.e. sleeping, position. The solenoid arrangement 16 may be activated by the signal transmitting unit 62. Once the signal transmitting unit 62 becomes spaced from the signal receiving unit 56 inside the doll 10, by a selected distance, e.g. 4 meters, the signal receiving unit 56 no longer receives a signal emitted by the signal transmitting unit 62. The electronic circuitry 54 then causes the solenoid arrangement 16 to be activated and the solenoid coil is energised. The solenoid bolts 18 then move from the first positions shown in FIG. 6, to the second positions shown in FIG. 7 and the eye balls 20 move from the first positions shown in FIG. 6 (eyes 14 closed) to the second positions shown in FIG. 7 (eyes 14 open).

Simultaneously, the electronic circuitry 54 causes the loudspeaker 58 to emit a sound which simulates the crying sound of an infant. The crying sound is created by a sound or voice synthesizer 80, which is part of the electronic circuitry 54 and may be a crying sound synthesizer IC chip. When the signal transmitting unit 62 is returned to the signal receiving unit 56 such that it is spaced therefrom by a distance less than the aforesaid selected distance, the signal receiving unit 56 receives the signal emitted by the signal transmitting unit 62. This causes the electronic circuitry 54 to de-energise the solenoid coil and also to deactivate the sound/voice synthesizer 80. When the solenoid coil is de-energised, the solenoid bolt 18 returns to the position shown in FIG. 6 in which it is biased out of the solenoid coil by the spring 50. The eye balls 20 then return from the position shown in FIG. 7 to the position shown in FIG. 6 to simulate the eyes being closed, i.e. a sleeping infant.

Thus, in summary, when the solenoid arrangement 16 is de-activated, the eyes 14 will be open when the doll 10 is upright, and closed when the doll 10 is lying down. However, when the doll 10 is lying down (with the eyes 14 closed) the solenoid arrangement 16 may be activated (by moving the signal transmitting unit 62 sufficiently far from the signal receiving unit 56 in the doll 10) which causes the eyes 14 to open; simultaneously the sound/voice synthesizer 80 causes a crying sound to be emitted from the loud speaker 58. This simulates a waking and crying infant.

Further, the electronic circuitry 54 may be provided with a time relay such that the sound/voice synthesizer 80 and solenoid arrangement 16 are de-activated if they remain on for a selected time, e.g. 3 minutes. This prevents power drain in the case that the signal transmitting unit 62 is not returned to the doll 10.

The doll 10 can be used as a toy by a child to simulate an infant crying when the infant's mother leaves him/her. The child clips the heart shaped signal transmitting unit 62 to her clothing, which places it in the "ON" condition as previously herein described. The child may lie the doll 10 down in which case the eye balls 20 will assume the positions shown in FIG. 6 relative to the casings 22 (eyes 14 "closed") simulating a sleeping infant. The signal transmitting unit 62 is carried by the child (on her clothing) and when the child moves away from the doll 10 by the aforesaid selected distance, the electronic circuitry 54 will cause the solenoid arrangement 16 to become activated and the eye balls 20 will move into position as shown in FIG. 7 (eyes 14 "open") and the sound/voice synthesizer 80 will be activated causing the loudspeaker 58 to emit an infant's crying sound. In this way, when the child moves away from the doll 10 by the aforesaid selected distance, the electronic circuitry 54 is activated and the eyes 14 open and the doll 10 cries to simulate an infant waking up because his/her mother has left him/her. When a child returns to the doll 10, the electronic circuitry 54 is de-activated and the eyes 14 close and the crying sound ceases.

A speech synthesizer 82 may also be provided in the electronic circuitry 54.

The speech synthesizer 82 may be used in a second mode of operation of the doll 10. In this second mode, the operation of the speech synthesizer 82 is activated when the signal transmitting unit 62 is brought to within a selected distance, or less (e.g. 1 meter or less), from the signal receiving unit 56. This causes the loudspeaker 58 to emit speech sound and the eyes 14 to open in the manner previously herein described. A control switch (not shown) may be provided on the signal transmitting unit 62 to switch operation to and from the second mode. The doll 10 may also be provided with a heart beat simulator device 100, shown in FIG. 1.

The heart beat simulator device 100 comprises a plate 102 pivotally attached to a base board 104. The plate 102 is held away from the base board 104 by a button 106 which extends from the base board 104 and is positioned just beneath the plate 102. The button 106 is connected to a heart beat sound synthesizer IC chip 108 of the electronic circuitry 54. The heart beat simulator device 100 may be connected to a power source, such as the cell or battery 60.

The heart beat simulator device 100 may be activated by pushing on the chest on the doll 10. This causes the plate 102 to push the button 106 which activates the heart beat sound synthesizer I.C chip 108. This causes a sound simulating a heart beat to be emitted from the loudspeaker 58. This heart beat sound is low in volume and is heard only when the listener's ear is on the chest of the doll 10.

Preferably, the pressure required for the plate 102 to push the button 106 can be effected by placing an ear on the chest of the doll 10 and pushing lightly thereon. The doll 10 may be further provided with a belch or "burp" simulator device 110.

The belch/"burp" simulator device 110 comprises a belch/"burp" sound synthesizer I.C chip 112 in the electronic circuitry 54 and a motion sensitive switch 111. The motion sensitive switch 111 may, for example, be a mercury switch or a pendulum switch.

The belch/"burp" simulator device 110 may be connected to a power source, such as the cell or battery 60.

The belch/"burp" simulator device 110 may be activated by shaking the doll 10 and/or patting it on its back, or any other suitable movement of the doll 10 which activates the motion sensitive switch 111. The belch/"burp" synthesizer I.C. chip 112 is in turn activated and a belch or "burp" sound is emitted from the loudspeaker 58.

The doll 10 may also be provided with a circuit disabling arrangement 150 in the form of a mouth switch. The circuit disabling arrangement 150 may be provided in the mouth of the doll 10.

The circuit disabling arrangement 150 comprises a tube 152 of substantially resilient material and a pair of contacts 154 and 156.

The contacts 154 and 156 are opposed to one another on the outside of the tube 152 and are biased into contact with one another around the tube 152 compressing the wall of the tube 152. This can be seen in FIG. 15. A pair of leads 158 and 160 extend from the contacts 154 and 156, respectively, to the electronic circuitry 54. The tube 152 and the contacts 154 and 156 are held in place in a small frame structure 162.

Figure 15:
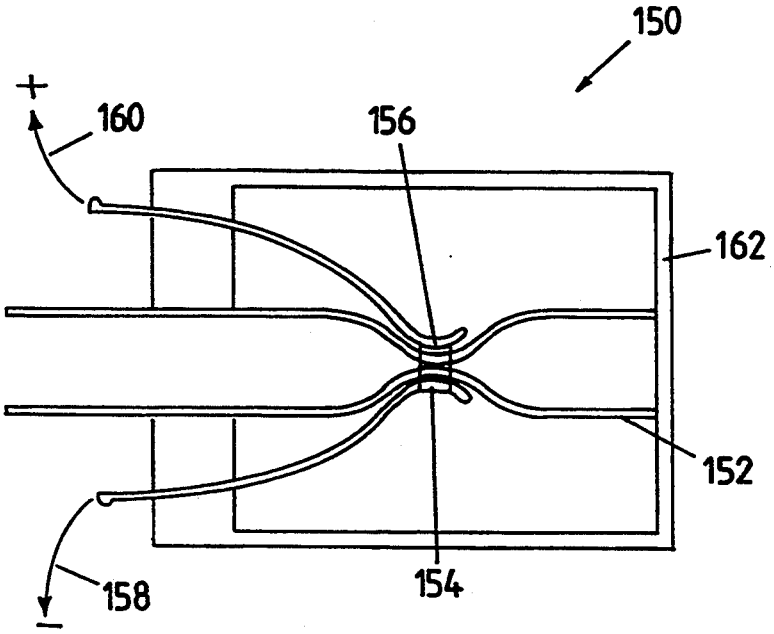
FIG. 15 is a second detail side elevational view of the disabling arrangement shown in FIG. 14.

When the contacts 154 and 156 are in contact (as shown in FIG. 15) the electronic circuitry 54 will enable the electrical functions of the doll 10 (as hereinbefore described) to be operated. When contact between the contacts 154 and 156 is broken, the solenoid arrangement 16, sound/voice synthesizer 80, belch/'-'burp" simulator device 110 and speech synthesizer 82 will not operate; however, the heart beat simulator device 100 will still be operable even when contacts 154 and 156 is broken. Contact between the contacts 154 and 156 may be broken by inserting a contact breaker member into the tube 152.

Preferably, the contact breaker member is in the form of an infant's dummy 164.

Figure 14:
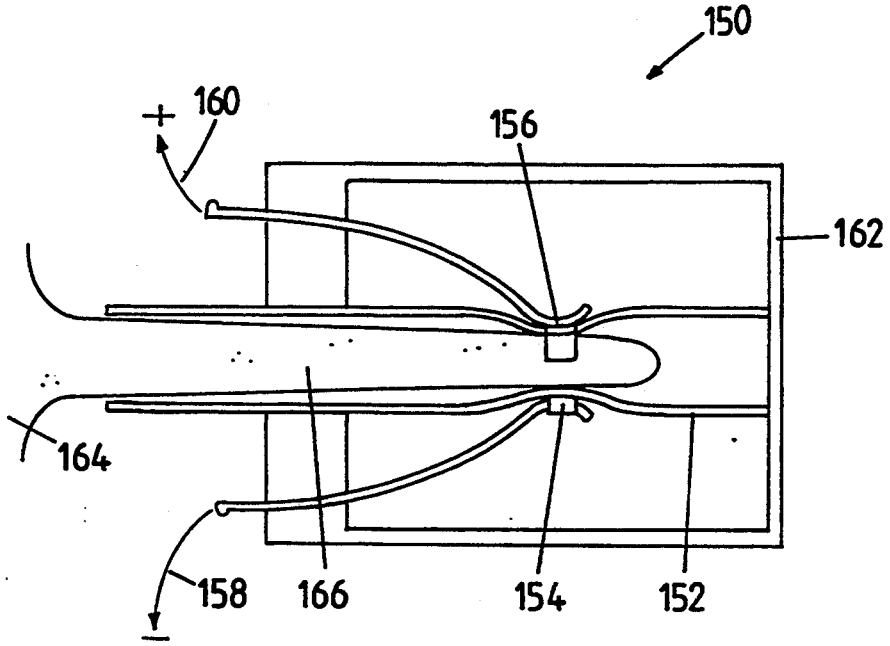
FIG. 14 is a first detail side elevational view of the disabling arrangement.

When the dummy 164 is inserted into the mouth of the doll 10 and into the tube 152, a projecting member 166 of the dummy 164 forces the contacts 154 and 156 apart and out of contact. This is shown in FIG. 14.

Thus, the child is able to disable the electronic circuitry 54 (except for the heart beat simulator device 100) by placing the dummy 164 in the mouth of the doll 10. As a general summary of the foregoing description, the doll of the present invention may be provided with the following functions/features which simulate a real baby and the love between a mother and her baby.

1. The doll is able to open its eyes and cry even though lying down when the (heart shaped) signal transmitting unit attached to the child's clothes is separated from the doll by a certain distance. However, when the signal transmitting unit is close to the doll, the eyes of the doll will function in the normal conventional manner, i.e. they open when the doll is upright and close when the doll is laid down.

2. The signal transmitting unit may be clipped to the child's clothes and it is only then that it is activated.

3. If the doll is lightly shaken it will produce a belch/"burp" sound.

4. The doll has a heart beat which can be activated by placing an ear against the doll's chest and applying slight pressure. This slight pressure activates the switch; otherwise the heart beat remains deactivated, saving the power source.

5. The doll has a second mode of operation incorporating a speech synthesizer.

6. A deactivating arrangement is also provided. By placing a dummy in the doll's mouth, the above functions are deactivated, except that the heart beat sound can be still activated as indicated above.

Modifications and variations such as would be apparent to skilled addressee are deemed within the scope of the present invention.

I claim:

1. A doll comprising:

a body having a head with at least one eye, said eye comprising a pivotal eye ball means; solenoid means having a moveable solenoid bolt; separate signal transmitting means; and, said body being provided with signal receiving means, wherein said eye ball means is pivotable between first and second positions simulating a closed and open eye, respectively, and said solenoid bolt is movable between first and second positions such that when said doll is in a substantially horizontal position and a signal emitted by said signal transmitting means is not received by said signal receiving means, said solenoid bolt moves from said first position to said second position which causes said eye ball means to pivot from said first position to said second position.

2. A doll according to claim 1, wherein said eye ball means is pivotally retained in casing means and has first arm means extending from a main portion thereof, and said solenoid means has second arm means which is movable by said solenoid bolt such that said second arm means causes said eye ball means to pivot from said first position to said second position.

3. A doll according to claim 1, wherein heart beat simulator means and loudspeaker means are provided and said heart beat simulator means comprises heart beat synthesizer means and switch means such that when said switch means is engaged said heart beat synthesizer means is activated and said loudspeaker means of said doll emits heart beat simulating sound.

4. A doll according to claim 1, wherein belch/"burp" simulator means and loudspeaker means are provided and said belch/"burp" simulator means comprises motion sensitive switch means and belch/"burp" synthesizer means such that when said motion sensitive switch means is engaged said belch/"burp" synthesizer means is activated and said loudspeaker means of said doll emits a belch/"burp" sound.

5. A doll according to claim 1, including a number of functions of said doll said functions comprising said solenoid means, a belch/"burp" simulator means, sound synthesizer means, voice synthesizer means, and speech synthesizer means and circuit disabling means is provided such that functions of said doll may be disabled from operation in said doll.

6. A doll according to claim 2, wherein said second arm means is connected to pivotal rod means and resilient means is provided to bias said rod means and said second arm means in a first direction and retain said solenoid bolt in said first position.

7. A doll according to claim 2, wherein said casing means has an opening therein through which said first arm means extends.

8. A doll according to claim 5, wherein said circuit disabling means comprises a pair of contacts having resilient tube means therebetween such that when contact breaker means is inserted into said resilient tube means said contacts are placed out of contact to break an electrical circuit of said doll such that said selected functions are disabled from operation.

9. A doll according to claim 1, wherein said separate signal transmitting means comprises a unit having an OFF condition and an ON condition, a pair of electrical contacts and clip means with pin means, said pin means biased to extend into an opening of said unit to break contact between said pair of electrical contacts to place said unit into said OFF condition, and said ON condition is engaged by preventing said pin means from extending into said opening to break said contact.

10. A doll according to claim 1, wherein sound synthesizer means and loudspeaker means are provided such that said sound synthesizer is activated when said solenoid bolt moves from said first position to said second position, and said loudspeaker means emits a crying sound.

11. A doll according to claim 1, wherein voice synthesizer means and loudspeaker means are provided such that said voice synthesizer means is activated when said solenoid bolt moves from said first position to said second position, and said loudspeaker means emits a crying sound.

12. A doll according to claim 1, wherein speech synthesizer means and loudspeaker means are provided and said speech synthesizer means is activated in a second mode of operation of said doll when a second signal is received by said signal receiving means from said signal transmitting means such that said speech synthesizer means is activated and said loudspeaker means emits speech sound and said solenoid bolt moves from said first position to said second position which causes said eye ball means to pivot from said first position to said second position.

13. A doll according to claim 1, wherein when said signal transmitting means is spaced from said signal receiving means by more than a first distance, said signal is not received by said signal receiving means, and when said signal transmitting means is spaced from said signal receiving means by less than said first distance, said signal is received by said signal receiving means such that said solenoid bolt returns to said first position which causes said eye ball means to pivot to said first position.

14. A doll according to claim 2, wherein said doll is provided with two said eyes, each of which comprises a pivotal eye ball means pivotally retained in casing means with first arm means extending from a main portion thereof, and wherein contact means extends between said first arm means of said two eyes, said contact means contactable by said second arm means to cause eye ball means of said two eyes to pivot from their said first position to their said second position.

15. A doll according to claim 2, wherein said doll is provided with two said eyes each of which comprises a pivotal eye ball means pivotally retained in casing means with first arm means extending from a main portion thereof, and wherein contact means is attached to said second arm means and is able to contact said first arm means of said two eyes to cause said eye ball means of said two eyes to pivot from their said first position to their said second position.

16. A doll according to claim 12, wherein said second signal is received by said signal receiving means in said second mode when said signal transmitting means is spaced from said signal receiving means by less than a second distance.

17. A doll comprising:

a body having a head with at least one eye, said eye comprising a pivotal eye ball means pivotally retained in casing means; first arm means extending from a main portion of said eye ball means; solenoid means having a movable solenoid bolt and second arm means movable by said solenoid bolt, said second arm means being connected to pivotal rod means; resilient means provided to bias said rod means and said second arm in a first direction, and retain said solenoid bolt in a first position, wherein said eye ball means is pivotable between first and second positions simulating a closed and open eye, respectively, and said solenoid bolt is moveable between said first position and a second position, such that when said doll is in a substantially horizontal position and said solenoid bolt moves from said first position to said second position, said second arm means moves to cause said eye ball means to pivot from said first position to said second position.

18. A doll according to claim 17, wherein separate signal transmitting means is provided, and said body is provided with signal receiving means such that when a signal emitted by said signal transmitting means is not received by said signal receiving means said solenoid bolt moves from said first position to said second position.

19. A doll according to claim 17, wherein heart beat simulator means and loudspeaker means are provided and said heart beat simulator means comprises heart beat synthesizer means and switch means such that when said switch means is engaged said heart beat synthesizer means is activated and said loudspeaker means of said doll emits heart beat simulating sound.

20. A doll according to claim 17, wherein belch/'-'burp" simulator means and loudspeaker means are provided and said belch/"burp" simulator means comprises motion sensitive switch means and belch/"burp" synthesizer means such that when said motion sensitive switch means is engaged, said belch/"burp" synthesizer means is activated and said loudspeaker means of said doll emits a belch/"burp" sound.

21. A doll according to claim 17, wherein circuit disabling means is provided such that functions of said doll may be disabled from operation, said functions comprising said solenoid means, a belch/"burp" simulator means, sound synthesizer means, voice synthesizer means, and speech synthesizer means.

22. A doll according to claim 17, wherein sound synthesizer means and loudspeaker means are provided such that said sound synthesizer means is activated when said solenoid bolt moves from said first position to said second position, and said loudspeaker means emits a crying sound.

23. A doll according to claim 17, wherein voice synthesizer means and loudspeaker means are provided such that said voice synthesizer means is activated when said solenoid bolt moves from said first position to said second position, and said loudspeaker means emits a crying sound.

24. A doll according to claim 17, wherein said casing means has an opening therein through which said first arm means extends.

25. A doll according to claim 17, wherein said doll is provided with two eyes, each of which comprises a pivotal eye ball means pivotally retained in casing means with first arm means extending from a main portion thereof, and wherein contact means extends between said first arm means of said two eyes, said contact means contactable by said second arm means to cause said eye ball means of said two eyes to pivot from their said first position to their said second position.

26. A doll according to claim 17, wherein said doll is provided with two said eyes each of which comprises a pivotal eye ball means pivotally retained in casing means with first arm means extending from a main portion thereof, and wherein contact means is attached to said second arm means and is able to contact said first arm means of said two eyes to cause said eye ball means of said two eyes to pivot from their said first position to their said second position.

27. A doll according to claim 18, wherein said separate signal transmitting means comprises a unit having an OFF condition and an ON condition, a pair of electrical contacts and clip means with pin means, said pin means biased to extend into an opening of said unit to break contact between said pair of electrical contacts to place said unit into said OFF position, and said ON condition is engaged by preventing said pin means from extending into said opening to break said contact.

28. A doll according to claim 18, wherein speech synthesizer means and loudspeaker means are provided and said speech synthesizer means is activated in a second mode of operation of said doll when a second signal is received by said signal receiving means from said signal transmitting means such that said speech synthesizer means is activated and said loudspeaker means emits speech sound and said solenoid bolt moves from said first position to said second position which causes said eye ball means to pivot from said first position to said second position.

29. A doll according to claim 18, wherein when said signal transmitting means is spaced from said signal receiving means by more than a first distance said signal is not received by said signal receiving means, and when said signal transmitting means is spaced from said signal receiving means by less than said first distance said signal is received by said signal receiving means such that said solenoid bolt returns to said first position which causes said eye ball means to pivot to said first position.

30. A doll according to claim 21, wherein said circuit disabling means comprises a pair of contacts having resilient tube means therebetween such that when contact breaker means is inserted into said resilient tube means said contacts are placed out of contact to break an electrical circuit of said doll such that said functions are disabled from operation.

31. A doll according to claim 28, wherein said second signal is received by signal receiving means in a second mode when said signal transmitting means is spaced from said signal receiving means by less than a second distance.

* * * * *